US005557293A

United States Patent [19]

McCoy et al.

[11] Patent Number: 5,557,293

[45] Date of Patent: Sep. 17, 1996

[54] MULTI-LOOP ANTENNA

[75] Inventors: Danny O. McCoy, Sunrise; Oscar Garay; Stanton B. McMillan, both of Coral Springs, all of Fla.

[73] Assignee: Motorola, Inc., Schaumburg, Ill.

[21] Appl. No.: 378,691

[22] Filed: Jan. 26, 1995

[51] Int. Cl.[6] ..... H01Q 1/24; H01Q 21/00

[52] U.S. Cl. ..... 343/867; 343/702; 343/870; 343/855

[58] Field of Search ..... 343/867, 742, 343/702, 866, 741, 743, 744, 870, 868, 855, 856; H01Q 1/24, 21/00

[56] References Cited

U.S. PATENT DOCUMENTS

| | | | |
|---|---|---|---|
| 2,412,249 | 12/1946 | Brown et al. | 343/867 |
| 4,847,626 | 7/1989 | Kahler et al. | 343/700 |
| 5,258,892 | 11/1993 | Stanton et al. | 361/814 |
| 5,337,061 | 8/1994 | Pye et al. | 343/702 |

FOREIGN PATENT DOCUMENTS

| | | | |
|---|---|---|---|
| 510172 | 2/1955 | Canada | 343/867 |
| 58-134505 | 8/1983 | Japan | 343/742 |
| 2100063 | 12/1982 | United Kingdom | 343/742 |

*Primary Examiner*—Hoanganh T. Le
*Attorney, Agent, or Firm*—Barbara R. Doutre

[57] ABSTRACT

A dual loop antenna (100) provides a dual frequency band response. The dual loop antenna (100) is configured on a substrate (102) which includes first and second radiator elements (106, 206) coupled through a common feed element (108).

13 Claims, 3 Drawing Sheets

MULTI-LOOP ANTENNA

TECHNICAL FIELD

This invention relates in general to antennas and more specifically to multi-loop antennas.

BACKGROUND

Small size is desirable in personal radio communication products, such as cordless telephone handsets. These space constraints in turn impose size restrictions on the radio components used in such products. For example, incorporating more than one antenna into a cordless telephone handset may require certain amounts of space not readily available in today's smaller handsets. For communication products requiring a dual band response, say for transmitting on one frequency and receiving on another, the problem is further complicated with regards to tuning the desired operating frequency bands and keeping them isolated by a separation bandwidth. Positioning of the antennas within the communication device becomes critical to the overall appearance of the device as well as its performance. Accordingly, there exists a need for an improved antenna structure that provides a dual band response and which can be readily implemented into a small communication device.

DETAILED DESCRIPTION OF THE PREFERRED EMBODIMENT

Small loop antennas typically measure $4/10$ wavelength ($\lambda$) or less, radiate off the sides of the loop (in the plane ), and effectively operate with patterns equivalent to a small dipole. Small loop antennas typically respond to magnetic fields, H-Fields, while straight wire antennas respond to electric fields, E-Fields. Large loop antennas are full wavelength resonators which radiate orthogonal to the plane of the loop.

Figure 2:
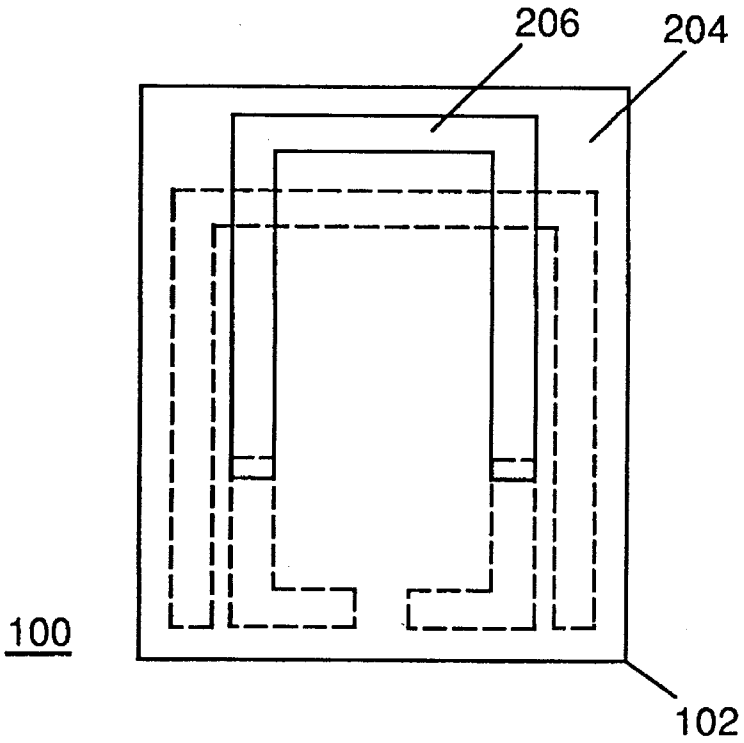
FIG. 2 is a back view of the antenna structure of FIG. 1 in accordance with the present invention.
Figure 1:
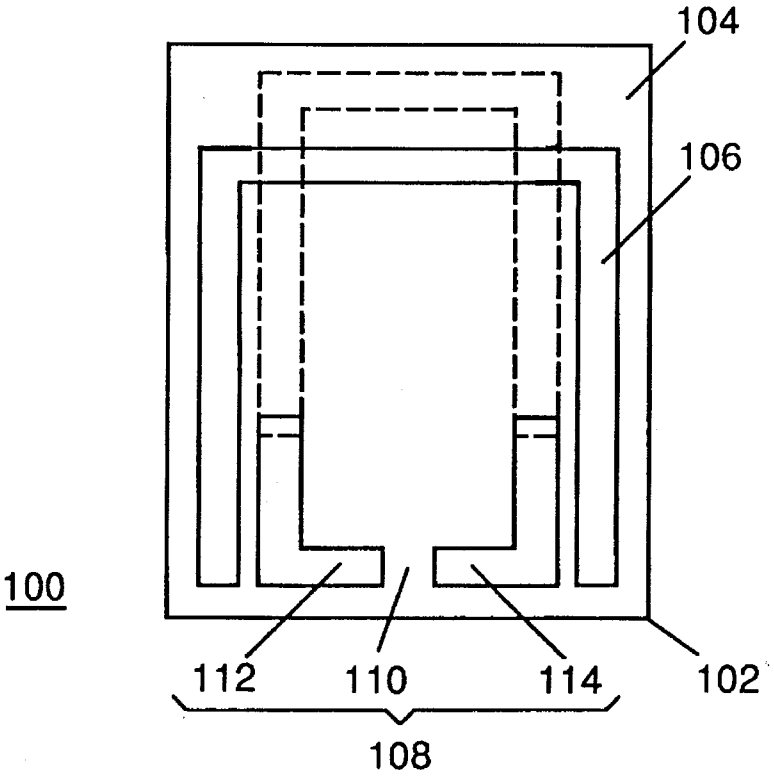
FIG. 1 is a front view of the preferred embodiment of an antenna structure in accordance with the present invention.

Referring now to FIGS. 1 and 2, there are shown front and back views respectively of the preferred embodiment of an antenna structure 100 in accordance with the present invention. The antenna structure 100 includes a substrate 102 of dielectric material such as fire retarding glass epoxy (FR4). Substrate 102 includes opposing first and second major surfaces 104 and 204 respectively, upon which first and second radiator elements 106, 206 are disposed on parallel planes. A feed section, also referred to as a feed element, 108 is disposed onto the substrate to act as a common coupling element for both of the first and second radiator elements 106, 206. By capacitively coupling, with edge and parallel plate coupling, the first and second radiator elements 106, 206 through a single feed section 108, a dual loop antenna consisting of two co-existing small loops capable of operation at two different frequencies is achieved.

Still referring to FIGS. 1 and 2, radiator elements 106, 206 and feed element 108 are formed out of an etched conductive material, such as copper. In the preferred embodiment, the first and second radiator elements 106, 206 are etched in U shaped patterns onto the first and second surfaces 104, 204 respectively. The second U shaped radiator element is partially positioned in between the first U shaped radiator element on the parallel plane and oriented in the same direction as shown. The feed element 108 is also disposed on the first surface of the substrate 102 in a U shaped pattern and includes a gap 110 that divides two conductive arms, radio frequency (RF) conductor 112 and ground conductor 114. The feed element 108 receives an RF signal though conductor 112 and ground through conductor 114. A transmission line, such as a coaxial cable (not shown), can be soldered to the RF conductor 112 and ground conductor 114 across the gap 110 to feed the RF signal. The feed element 108 presents a load of approximately 50 ohms to its source (not shown) such that both radiator elements 106, 206 behave electrically as independent small loop antennas that can be tuned to operate at different frequencies. When each of the U shaped radiators 106, 206 is capacitively coupled to the feed element 108 geometric loops which translate into small loop antennas are formed.

In the preferred embodiment of the invention, the wider of the two radiating elements 106 is edge coupled to the feed element 108 while the second radiator element 206 is in register, or parallel plate coupled, to the feed element. Two isolated frequency bands can be designed having a desired separation bandwidth using this configuration. The wider of the two radiator elements (the longer loop) provides the lower frequency band operation and the narrower of the two radiator elements (the shorter loop) provides the higher frequency band operation.

Predetermined portions of the conductive arms of the feed element 108 are used to edge couple to the first radiator portion 106 and parallel plate couple to the second radiator portion 206. By varying the length and width of the radiator elements 106, 206 as well as the length and width of the feed element 108, the coupling effects can be altered to tune the dual loop antenna 100 for individual predetermined resonant frequencies.

Figure 4:
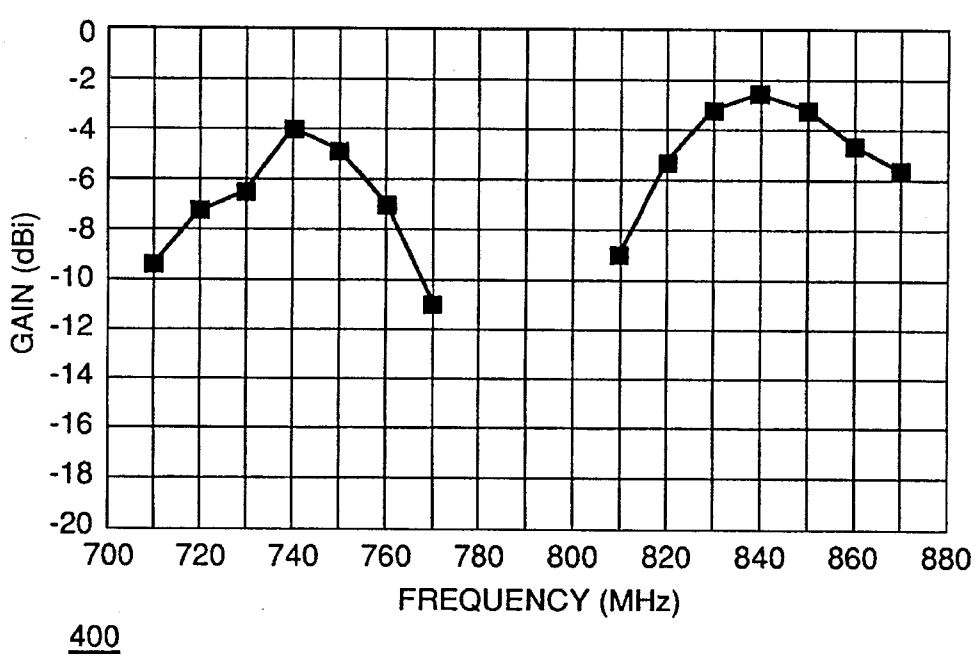
FIG. 4 is a graph of the gain of the same antenna structure as that used for FIG. 3 in accordance with the present invention.
Figure 3:
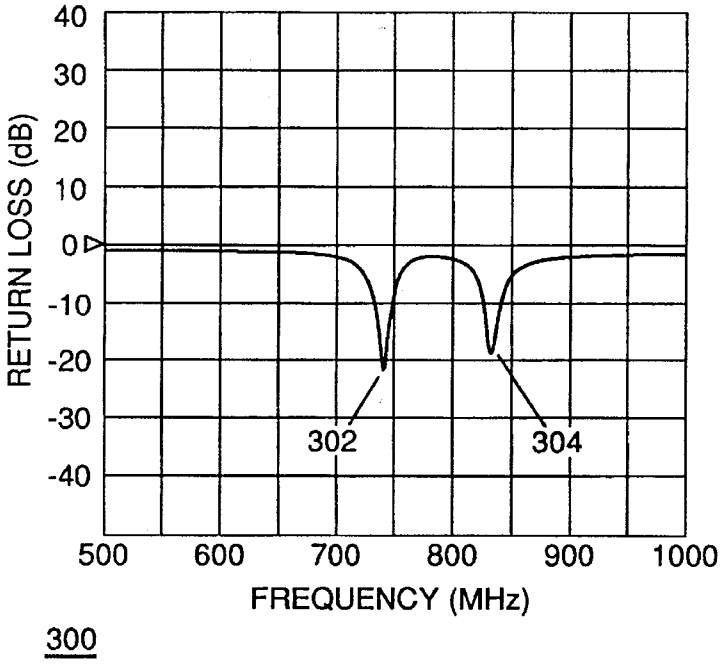
FIG. 3 is a graph of the return loss of an antenna structure made in accordance with the preferred embodiment of the present invention.

FIG. 3 shows a graph 300 of the return loss in decibels (dB) versus frequency in megahertz (MHz) of an antenna structure built in accordance with the preferred embodiment of the invention. FIG. 4 shows a graph 400 of gain measured in decibels relative to an isotropic antenna (dBi) versus frequency for the same antenna structure as that used for the data of FIG. 3. Each radiator element combined with the feed element formed a small loop antenna somewhat less than $4/10\lambda$ shaped from etched copper disposed onto FR4 substrate material. The antenna structure provided a return loss of approximately 20 dB at 744 MHz as shown by designator 302 and 19 dB at 835 MHz as shown by designator 304. The average gain shown in graph 400 was measured with the antenna structure oriented in the principal plane and rotated over 360 degrees in free space. As illustrated by graph 400, the antenna structure provided a maximum average gain of −4.0 dBi at 740 MHz and −2.4 dBi at 840 MHz. Hence, the antenna structure built in accordance with the invention provided two controllable isolated frequency bands.

To achieve the results shown in graphs 300 and 400, the following dimensions were used in the construction of the dual loop antenna. Referring to the orientation of FIG. 1 and 2, all the metallized etching widths measured approximately 0.3 centimeters (cm). The first radiator element 106 had an approximate total length of 14 cm and measured approximately 4.8 cm from top to bottom and 4.4 cm from left to right. The feed element 108 had an approximate total length of 6.4 cm and measured approximately 1.45 cm from top to bottom and 3.5 cm from left to right. The gap between the RF conductor 112 and the ground conductor 114 measured approximately 0.32 cm and the spacing between the first radiator element 106 and predetermined portions of the feed element 108, used for the edge coupling, measured approximately 0.16 cm. The second radiator element 206 had an approximate total length of 11.7 cm and measured approximately 4.1 cm from top to bottom and 3.5 cm from left to right. The second U shaped radiator element 206 overlapped, so as to register, with predetermined portions of the feed element 108 on the first surface 104. The spacing between the tops of the first and second radiator elements 106, 206 measured approximately 0.3 cm. The wider first radiator element 106 controlled the lower frequency response while the narrower second radiator element 206 controlled the higher frequency response.

Figure 5:
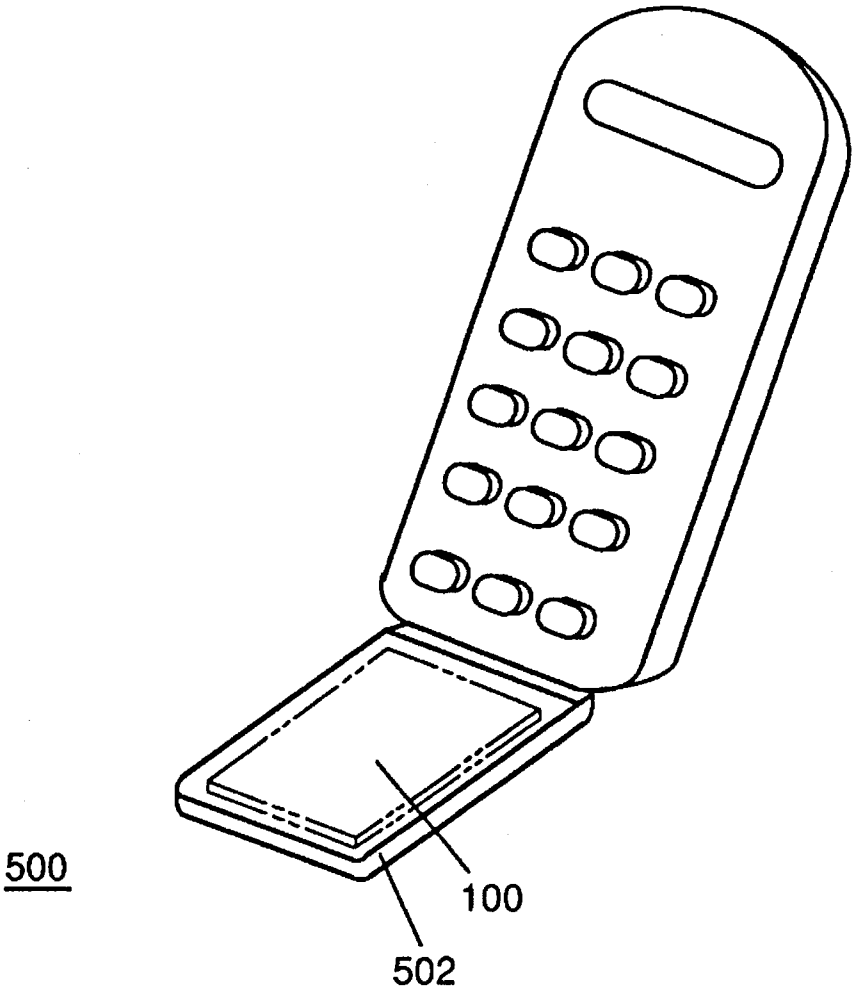
FIG. 5 is drawing of a communication device employing an antenna structure in accordance with the present invention.

The antenna structure as described by the invention can be scaled to operate at different frequencies by varying the length and width of the etched conductive material and using substrate materials having different dielectric constants. The antenna structure is thus selectively alterable to desired operating frequencies. Once a particular design achieves the desired response, the antenna structure can be fabricated using automated processes. The antenna dimensions that were used to achieve the data of FIGS. 3 and 4 provide an antenna structure that fits readily into portable communication devices, such as portable cellular telephones or other two way radios. FIG. 5 of the accompanying drawings shows an example of a communication device 500 having a flap 502 within which a dual loop antenna structure 100, as described by the invention, is enclosed. The dual loop antenna can make connection to the rest of the radio though a single coaxial cable (not shown) or other connector means coupled to the feed section. Because the antenna structure 100 as described by the invention uses small loops responsive to H-Fields, it is less susceptible to radiation pattern degradation and return loss variations when installed within a communication device, such as communication device 500.

The foregoing describes a dual loop antenna structure which is capable of being fabricated by automated processes with minimal cost using conventional printed circuit board technology. Not only does the antenna structure provide the benefit of dual bands which are useful for both transmitting and receiving, but the structure can also be designed to operate in a broader single band by altering the two loops to overlap their resonant frequencies. While the preferred embodiment is described using a two layer substrate, one skilled in the art can realize that multiple layers and loops could be used, for example the feed element could be placed on an inner layer if desired. Numerous modifications, changes, variations, substitutions and equivalents will occur to those skilled in the art without departing from the spirit and scope of the present invention as defined by the appended claims. The benefits of the antenna structure as described by the invention make it a desirable approach for many of today's smaller communication devices.

What is claimed is:

1. A dual loop antenna, comprising:

a substrate having first and second surfaces;

a feed section located on the first surface of the substrate;

a first radiator element located on the first surface of the substrate, said first radiator element capacitively coupled to the feed section, said first radiator element and said feed section providing a first loop antenna; and a second radiator element located on the second surface of the substrate, said second radiator element parallel plate coupled to the feed section, said second radiator element and said feed section forming a second loop antenna.

2. A dual loop antenna as described in claim 1, wherein said first loop antenna resonates at a first predetermined frequency and said second loop antenna resonates at a second predetermined frequency different from the first predetermined frequency.

3. A dual loop antenna as described in claim 1, wherein the feed section comprises a radio frequency (RF) conductor and a ground conductor, a predetermined portion of said first radiator element being edge coupled to the RF conductor of said feed section and a second predetermined portion of said first radiator element being edge coupled to the ground conductor of said feed section.

4. A dual loop antenna as described in claim 3, wherein a predetermined portion of said second radiator element being in register to the RF conductor of said feed section, and a second predetermined portion of said second radiator element being in register to the ground conductor of said feed section.

5. A dual loop antenna, comprising:

a substrate having first and second opposing surfaces;

a feed section located on the first surface of the substrate, said feed section including a radio frequency (RF) conductor portion and a ground conductor portion;

a radiator element located on the first surface and forming a first geometric loop when capacitively coupled to predetermined portions of the RF conductor and the ground conductor portion of the feed section;

a radiator element located on the second surface of the substrate and forming a second geometric loop when overlapped with predetermined portions of the RF conductor portion and the ground conductor portion of the feed section; and said first and second geometric loops providing first and second loop antennas.

6. A dual antenna structure for a communication device, said dual antenna structure including a substrate and first and second radiating elements integrated on opposing surfaces of the substrate and capacitively coupled to a common radio frequency (RF) feed located on one of the opposing surfaces to form independent radiating loops.

7. A dual antenna structure as described in claim 6, wherein said first radiating element is edge coupled to the common RF feed and wherein said second radiating element is parallel plate coupled to the common RF feed.

8. A dual antenna structure as described in claim 6, wherein each of said first and second radiating elements comprises a predetermined width and length and wherein an operating frequency for each of said independent radiating loops is controlled by said predetermined width and length.

9. A dual antenna structure for a communication device as described in claim 6, wherein the communication device comprises a portable radio.

10. A dual loop antenna structure, comprising:

a substrate of dielectric material having first and second surfaces;

a feed section situated on said first surface including a radio frequency (RF) conductor and a ground conductor;

a first radiator element located on the first surface of the substrate and having first and second end portions, the first end portion is capacitively coupled to the RF conductor and the second end portion is capacitively coupled to the ground conductor of the feed section, said feed section and capacitively coupled first radiator element forming a first loop antenna; and a second radiator element located on the second surface of the substrate and having first and second end portions, the first end portion is parallel plate coupled to the RF conductor and the second end portion is parallel plate coupled to the ground conductor of the feed section, said feed section and parallel plate coupled second radiator element forming a second loop antenna.

11. A multi-loop antenna, comprising:

a substrate;

a first radiator element disposed on the substrate;

a second radiator element disposed on the substrate;

a coupling element disposed on the substrate and capacitively coupled to the first radiator element and the second radiator element; and said first and second radiator elements and said coupling element forming first and second electrical loops resonant at different frequencies.

12. A dual loop antenna, comprising:

a substrate having first and second surfaces in parallel planes;

a first U shaped radiator element disposed on the first surface, said first U shaped radiator element being characterized by a predetermined length and width;

a second U shaped radiator element disposed on the second surface and oriented in the same direction as the first U shaped radiator element, said second U shaped radiator element being characterized by a length shorter than that of the first U shaped radiator element and having a substantially equivalent width to that of the first U shaped radiator element;

a U shaped coupling element including a substantially centrally located gap, said U shaped coupling element disposed on the first surface of the substrate and oriented in an opposing direction to both the first and second U shaped radiator elements, said U shaped coupling element having first predetermined portions capacitively coupled to the first U shaped radiator element and having second predetermined portions substantially in register with the second U shaped radiator element; and said U shaped coupling element forming first and second electrical loops with both the first U shaped radiator element and the second U shaped radiator element respectively, each of said first and second electrical loops resonant at a different frequency.

13. A dual loop antenna as described in claim 12, wherein the resonant frequency of the first and second electrical loops is selectively alterable by varying the width and length of the first and second U shaped radiator elements.

* * * * *